United States Patent [19]

Kim

[11] Patent Number: 4,911,040

[45] Date of Patent: Mar. 27, 1990

[54] ADJUSTABLE SOCKET WRENCH

[76] Inventor: Ee J. Kim, 22040 Strathern St., #4, Canoga Park, Calif. 91304

[21] Appl. No.: 319,171

[22] Filed: Mar. 6, 1989

[51] Int. Cl.[4] ..... B25B 13/18

[52] U.S. Cl. ..... 81/128; 279/69

[58] Field of Search ..... 81/112, 114, 115, 128, 81/129, 352, 361, 362, 363; 279/61-65, 69-70, 74

[56] References Cited

U.S. PATENT DOCUMENTS

| | | | |
|---|---|---|---|
| 1,817,988 | 8/1931 | Klamt | 81/352 X |
| 2,631,485 | 3/1953 | Stuart et al. | 81/112 X |
| 2,745,305 | 5/1956 | Reiffin | 81/128 |
| 3,373,639 | 3/1968 | Van Dalen et al. | 81/112 |
| 3,898,897 | 8/1975 | Jauhiainen | 81/114 |
| 4,385,534 | 5/1983 | Nichols | 81/114 |

FOREIGN PATENT DOCUMENTS

| | | | |
|---|---|---|---|
| 851798 | 10/1960 | United Kingdom | 81/128 |

*Primary Examiner*—D. S. Meislin

[57] ABSTRACT

An improved adjustable socket wrench comprising a bifurcated base member having a threaded external surface, a plurality of elongated gripping arms having upper and lower apertures formed in said arms, a parallellogram linkage system connecting said gripping arms to said base member and serving to maintain said gripping arms in parallel relationship during movement, resilient means normally urging said linkage system and said gripping arms to a raised open position, and nut means mating with the threaded surface of said base member and serving to drive said linkage system and said gripping arms against the action of said resilient means to a clamping position.

8 Claims, 1 Drawing Sheet

ADJUSTABLE SOCKET WRENCH

BACKGROUND

1. Field of Invention

This invention relates to hand tools and is particularly directed to socket wrenches which are adjustable to accommodate bolts of a plurality of sizes.

2. Prior Art

For many years, wrenches have been extremely useful tools for tightening and loosening nuts, bolts and the like. More recently, adjustable wrenches have found wide acceptance, since they are readily adaptable to accommodate nuts and bolts of a wide variety of sizes. Still more recently, socket wrenches have gained wide acceptance. Socket wrenches are tubular members having a driving end of generally hexagonal configuration, sized to fit a nut or bolt of a given size and having the opposite end formed to receive a drive mechanism, which may be either manual or powered. The advantage of the socket wrenches is that they be driven by power sources, as well as manually. However, the socket wrenches of the prior art have not been adjustable. Hence, it has been necessary to purchase sets of socket wrenches to accommodate most standard sizes of nuts and bolts. Unfortunately, American products are generally made using nuts and bolts of American dimensions, whereas products from most of the rest of the world employ nuts and bolts of metric dimensions. Thus, separate sets of socket wrenches have been required to fit nuts and bolts of each dimension system. Furthermore, it is customary to provide socket wrench sets for only limited ranges of sizes. Thus, for example, one set of socket wrenches would accommodate nuts and bolts having heads of less than one inch diameter, while a separate set of socket wrenches would be required to accommodate nuts and bolts having heads of one to two inch diameter and larger sizes of socket wrenches are usually sold separately.

Numerous attempts have been made heretofore to provide adjustable socket wrenches. However, some of the prior art adjustable socket wrenches have been extremely expensive to produce and have been complicated or difficult to use. Other prior adjustable socket wrenches have been unable to withstand the torque required for normal usage of such devices. Still other prior art adjustable socket wrenches have failed to provide adequate gripping action over more than a very limited range of diameters. A search in the United States Patent Office has revealed the following references:

| U.S. Pat. No. | INVENTOR | ISSUED |
|---|---|---|
| 2,631,485 | D. O. Stuart et al | Mar. 17, 1953 |
| 3,373,639 | L. Van Dalen et al | Mar. 19, 1958 |
| 3,898,897 | T. U. Jauhainen | Aug. 12, 1975 |
| 4,385,534 | C. R. Nichols | May 31, 1983 |

Each of these reference teaches a set of arms with essentially a nut which can be tightened to cause the arms to clamp a desired object. The patent to Stuart et al teaches an extremely complex structure which would be very expensive to produce. The remaining patents each have gripping arms which generally engage the article to be clampled at a slight angle and, hence, would tend to slide off of the article. Thus, none of the prior art adjustable socket wrenches have been entirely satisfactory.

BRIEF SUMMARY AND OBJECTS OF THE INVENTION

These disadvantages of the prior art are overcome with the present invention and is adjustable socket wrench is provided which is able to accommodate nuts and bolts having heads of a wide range of diameters and which has gripping members which engage the article to be clamped parallel to the sides of the article to assure firm gripping of the article.

The advantages of the present invention are preferably attained by providing improved adjustable socket wrenches comprising a bifurcated hollow base member having a threaded external surface, a plurality of elongated gripping arms having upper and lower apertures formed in said arms, the gripping surfaces of said arms having recessed formed therein whose sides form an angle of approximately 128°, and a parallelogram linkage system comprising a pair of link members each having one end pivotally secured to each other and having their opposite ends pivotally secured to the lower aperture of a respective one of said gripping arms, a pair of cam members each having one end pivotally secured to each other and to the interior of said base member and having their opposite ends pivotally secured to the upper aperture of a respective one of said gripping arms, resilient means normally urging said cam members and said gripping arms to a raised position, and a sleeve member threadedly mounted on the exterior of said base member and having a lower edge engageable with said cam members to drive said cam members and said gripping arms to a gripping position.

Accordingly, it is an object of the present invention to provide improved socket wrenches.

Another object of the present invention is to provide improved socket wrenches which are adjustable to accommodate nuts and bolts having heads of a wide range of diameters.

An additional object of the present invention is to provide an improved adjustable socket wrench which is simple and inexpensive to produce, yet which is rugged enough to withstand normal usage of such tools.

A further object of the present invention is to provide an improved adjustable socket wrench having jaws which engage a nut or bolt to be clamped thereby parallel to the sides of said nut or bolt.

A specific object of the present invention is to provide an improved adjustable socket wrench comprising a bifurcated base member having a threaded external surface, a plurality of elongated gripping arms having upper and lower apertures formed in said arms, the gripping surface of said arms having recesses formed therein whose sides form an angle of approximately 120°, and a parallellogram linkage system comprising a pair of link members each having one end pivotally secured to each other and having their opposite ends pivotally secured to the lower aperture of a respective one of said gripping arms, a pair of cam members each having one end pivotally secured to each other and to the interior of said base member and having their opposite ends pivotally secured to the upper aperture of a respective one of said gripping arms, resilient means normally urging said cam members and said gripping arms to a raised position, and a sleeve member threadedly mounted on the exterior of said base member and having a lower edge engageable with said cam members to drive said cam members and said gripping arms to a gripping position.

These and other objects and features of the present invention will be apparent from the following detailed description, wherein reference is made to the figures of the accompanying drawings.

DETAILED DESCRIPTION OF THE INVENTION

Figure 1:
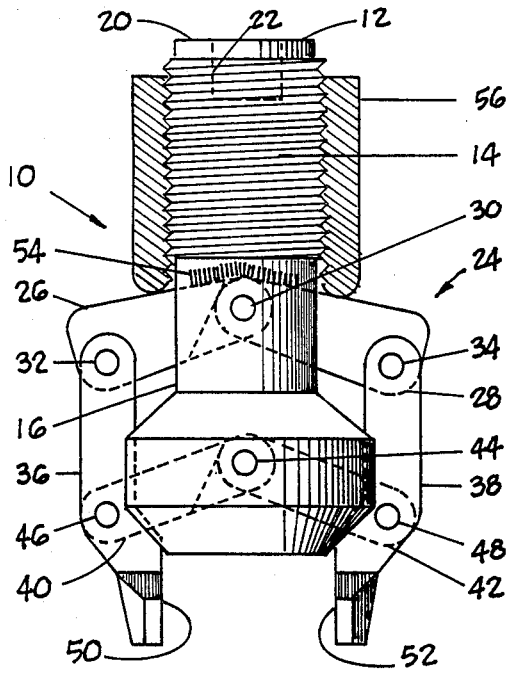
FIG. 1 is a front elevation, partly in section, of an adjustable socket wrench embodying the present invention with the jaws shown in their open position.
Figure 2:
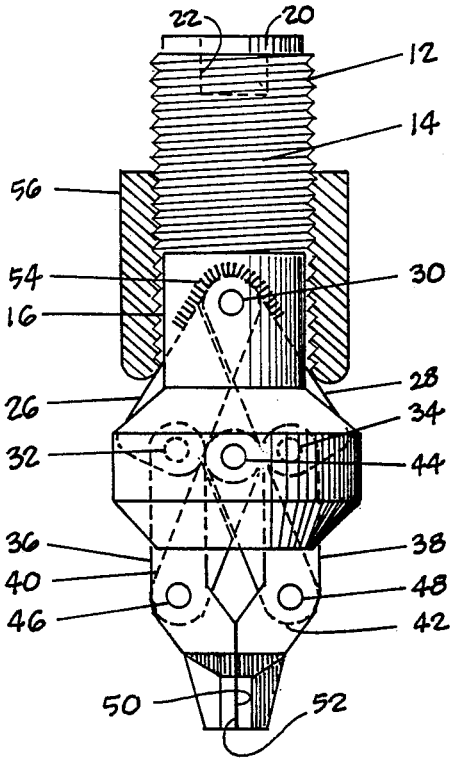
FIG. 2 is a view, similar to that of FIG. 1, showing the adjustable socket wrench of FIG. 1 with the jaws in their gripping position.
Figure 4:
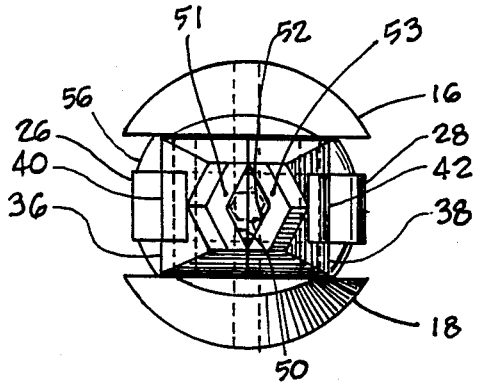
FIG. 4 is a bottom view of the adjustable socket wrench of FIG. 2.
Figure 3:
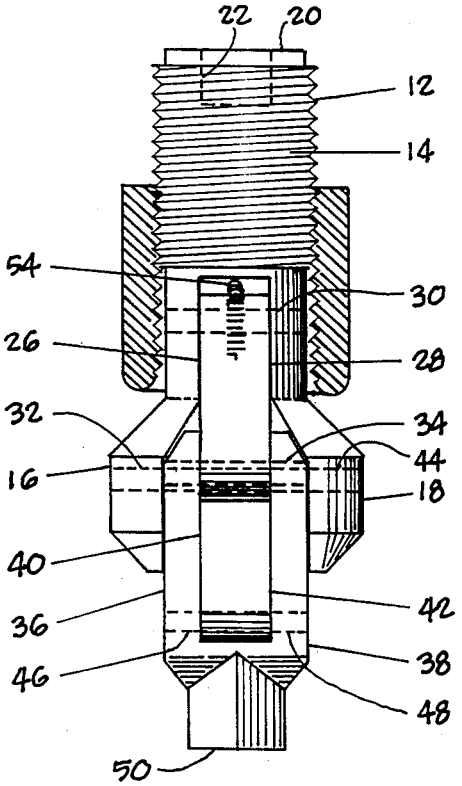
FIG. 3 is a side view, partly in section , of the adjustable socket wrench of FIG. 2.

In that form of the present invention chosen for purposes of illustration in the drawings, FIG. 1 shows an adjustable socket wrench, indicated generally at 10, comprising a base member 12 having a threaded external surface 14 and formed with a bifurcated lower end terminating in a pair of spaced arms 16 and 18. The upper end 20 of the base member 12 is formed with a generally rectangular recess 22 for receiving the tip, not shown, of a suitable drive mechanism, such as a crank or a power tool. A parallellogram linkage system, indicated generally at 24 comprises pair of elongated cam members 26 and 28, each having one end pivotally secured to each other and to the interior of the base mamber 12 by suitable means, such as pin 30. The opposite ends of the cam members 26 and 28 are pivotally secured,-as by pins 32 and 34, to the upper ends of a respective one of a pair of elongated gripping members 36 and 38. A second pair of link members 40 and 42 have the upper ends thereof pivotally secured to each other and to the interior of the base member 12 by suitable means, such as pin 44, while the lower end of link member 40 is pivotally secured to gripping member 36 by pin 46 and the lower end of link member 42 is pivotlly secured to gripping member 38 by pin 48. The link members 40 and 42 are appropriately sized and the location of the pivot points 46 and 48 are selected such that cam members 26 and 28, gripping members 36 and 38 and link members 40 and 42 form a parallellogram linkage system 24 which serves to constantly maintain the gripping surface 50 and 52 of the gripping members 36 and 38 in a parallel vertical relationship. Finally, resilient means, such as spring 54, is connected to the cam members adjacent the upper ends thereof to normally urge the cam members to the raised open position shown in FIG. 1, while a nut member 56 is internally threaded to mate with the externally threaded surface 14 of the base member 12 and serves to drive the cam members 26 and 28 downwardly against the action of spring 54 to cause the gripping surfaces 50 and 52 of the gripping members 36 and 38 to engage and clamp an article therebetween. As best seen in FIG. 4, the gripping surfaces 50 and 52 have recesses formed therein, as seen at 51 and 53 in FIG. 4, whose sides form an angle of approximately 120°. This serves to guide a socket to be gripped into engagement by the gripping members 36 and 38 and facilitates gripping of oddly shaped sockets.

In use, the nut member 56 is threaded upwardly, allowing spring 54 to urge the cam members 26 and 28 upwardly and causing the gripping surfaces 50 and 52 of the gripping members 36 and 38 to spread apart to the position shown in FIG. 1. Thereafter, the gripping surfaces 50 and 52 of the gripping members 36 and 38 are positioned adjacent respective sides of an article to be clamped and the nut member 56 is threaded downward. AS the nut member 56 moves downward, it bears against the cam members 26 and 28 and drives them downward, while the link members 40 and 42 serve to maintain the gripping members 36 and 38 in parallel vertical relation. If the article to be clamped is a nut, bolt or the like, the action of the parallellogram linkage system 24 assures that the gripping surfaces 50 and 52 of the gripping members 36 and 38 will engage the article to be clamped parallel to the sides of the article and, hence, will prevent the wrench 10 from damaging or slipping off of the article to be clamped. It will be apparent from the foregoing description that the wrench 10 can easily be adjusted to accommodate a wide range of sizes of nuts, bolts and the like.

Obviously, numerous variations and modifications can be made without departing from the spirit of the present invention. Therefore, it should be clearly understood that the form of the present invention described above and shown in the figures of the accompanying drawings is illustrative only and is not intended to limit the scope of the present invention.

What is claimed is:

1. An adjustable socket wrench comprising:

a bifurcated base having a threaded external surface, a plurality of elongated gripping members, a parallellogram linkage means connecting said gripping members to said base and maintaining said gripping members in parallel relationship during movement, resilient means normally urging said linkage system and said gripping members to a raised open position, and internally threaded nut means mating with said external surface of said base and actuable to drive said linkage system downward to cause said gripping members to clamp an article therebetween.

2. The wrench of claim 1 wherein:

Said linkage means comprises:

a pair of elongated cam members each having one end pivotally connected to each other and to said base and having their opposite ends pivotally connected to the upper end of a respective one of said gripping members, and a pair of link members each having one end pivotally connected to each other and having their opposite ends pivotally connected to a respective one of said gripping members.

3. The wrench of claim 1 further comprising:

A recess formed in the upper end of said base for receiving the tip of a suitable drive means.

4. The wrench of claim 1 wherein:

said gripping means are elongated members having upper and lower apertures formed therin, and said linkage means comprises:

a pair of link members each having one end pivotally secured to each other and having their opposite ends pivotally secured to the lower aperture of a respective one of said gripping members, and a pair of cam members each having one end pivotally secured to each other and to the interior of said base and having their opposite ends pivotally secured to the upper aperture of a respective one of said gripping members.

5. The wrench of claim 4 further comprising:

a first pin pivotally connecting said one end of each of said cam members to each other and to said base between the bifurcated ends of said base.

6. The wrench of claim 2 further comprising:

a first pin pivotally connecting said one end of each of said cam members to each other and to said base between the bifurcated ends of said base.

7. The wrench of claim 1, wherein:

said resilient means is a spring connected to each of said cam members.

8. The wrench of claim 1 further comprising:

said gripping members having gripping surfaces formed with recesses therein whose sides form an angle of approximately 120°.

* * * * *